United States Patent [19]

Lepperhoff

[11] Patent Number: 4,709,549

[45] Date of Patent: Dec. 1, 1987

[54] ASSEMBLY FOR ENGINE EXHAUST GAS PARTICULATE FILTER TRAPS

[75] Inventor: Gerhard Lepperhoff, Eschweiler, Fed. Rep. of Germany

[73] Assignee: FEV Motorentechnik GmbH & Co. KG, Aachen, Fed. Rep. of Germany

[21] Appl. No.: 25,818

[22] Filed: Mar. 13, 1987

[30] Foreign Application Priority Data

Mar. 13, 1986 [DE] Fed. Rep. of Germany ..... 3608371

[51] Int. Cl.[4] ..... F01N 3/02

[52] U.S. Cl. ..... 60/295; 55/484; 55/502; 55/DIG. 30; 60/311; 422/179

[58] Field of Search ..... 60/295, 311; 55/484, 55/503, 502, 511, DIG. 30; 422/179, 180

[56] References Cited

U.S. PATENT DOCUMENTS 4,283,207 8/1981 Martyniuk ..... 55/DIG. 30
4,352,783 10/1982 Bailey ..... 55/DIG. 30
4,462,812 7/1984 Bly ..... 55/DIG. 30

FOREIGN PATENT DOCUMENTS 180712 10/1983 Japan ..... 60/311
1289928 9/1972 United Kingdom .

*Primary Examiner*—Douglas Hart
*Attorney, Agent, or Firm*—Watson, Cole, Grindle & Watson

[57] ABSTRACT

An assembly for particulate filter traps in which engine exhaust particulates are deposited for the treatment of internal combustion emission, includes a filter trap support containing a plurality of individual particulate filter traps arranged side-by-side and parallel to the direction of exhaust gas flow therethrough. An inflow housing overlying the trap support is removable for inspection of the filter traps, and a sectioned cover of the trap support underlying the removable housing permits one or more individual traps to be inspected and separately replaced.

3 Claims, 3 Drawing Figures

ASSEMBLY FOR ENGINE EXHAUST GAS PARTICULATE FILTER TRAPS

BACKGROUND OF THE INVENTION

This invention relates to an assembly for particulate filter traps in which engine exhaust gas particulates are deposited for the treatment of internal combustion engine emission.

For engine exhaust treatment systems, in particular for ceramic particulate filter traps for motor vehicle engines, volumes in excess of the engine stroke volume are necessary. Such large particulate filter traps for vehicles risk breakage and are sensitive to the thermal tensions that arise in the presence of particle oxidation. For this reason, a plurality of small particulate filter traps, mounted in parallel, are employed in lieu of a large particulate filter trap.

The useful life of the motor vehicle far exceeds the useful life of the particulate filter trap coupled into the engine exhaust system. The filter trap oftentimes becomes clogged with soot deposits collected during exhaust gas purification, thereby requiring frequent trap replacement. In addition, the filter traps deteriorate and become inefective due to thermal cracking and "melting-on" during soot oxidation. It is therefore desirable to provide an assembly for particulate filter traps for the exhaust gas of internal combustion engines, in which trap damage can be identified and dealt with in ample time to avoid long range problems.

British Pat. No. 1289928 discloses an exhaust gas treatment device provided with catalytic cleaning means in which reducing and oxidizing catalyzing agents are formed in cast-iron molds which are affixed to a removable base plate of the device. Although the individual catalytic filter traps can be removed and replaced with such an arrangement, the operation is relatively complicated and time consuming since the entire assembly must be opened to remove the individual catalytic traps for inspection and, if necessary for replacing the damaged or clogged traps.

SUMMARY OF THE INVENTION

It is therefore an object of the present invention to provide an assembly for particulate filter traps in which engine exhaust particulates are deposited for the treatment of internal combustion engine emission, wherein damaged or clogged filter traps can be inspected and dealt with in a simple and economical yet highly efficient manner particularly during the course of typical vehicle or engine maintenance procedures. Thus, the vehicle operator or repairman is able to frequently monitor the condition of the filter traps so that trap damage, which can lead to a deterioration of the composition of engine emission, is recognized as early as possible.

The assembly includes a filter trap support in the form of a receptacle containing a plurality of individual particulate filter traps arranged side-by-side and parallel to the direction of exhaust gas flow therethrough, and a cover on the receptacle. Aligned openings in the receptacle and cover are coaxial with the traps, an in-flow housing is coupled to an exhaust pipe section leading from the engine, and a outflow housing is coupled to another exhaust pipe section through which the purified exhaust gas flows. The housings are mounted on opposite sides of the trap support in open communication with the traps via the openings. One of the housings is removably mounted to the cover for inspection of the filter traps through the cover openings upon removal of such housing, and the cover includes a plurality of cover sections removably mounted on the receptacle with each of the sections associated with at least one of the traps so as to facilitate trap replacement upon removal of at least one of the cover sections.

Other objects, advantages, and novel features of the invention will become more apparent from the following detailed description of the invention when taken in conjunction with the accompanying drawings.

DETAILED DESCRIPTION OF THE INVENTION

Figure 2:
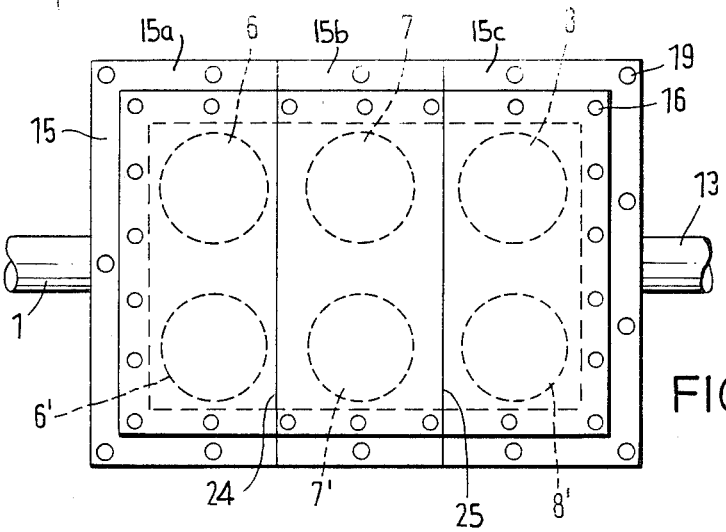
FIG. 2 is a top plan view of the assembly of FIG. 1.
Figure 3:
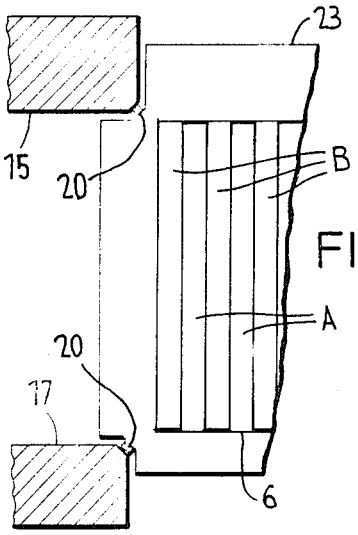
FIG. 3 is an enlarged detailed view illustrating the securement of a typical filter trap within the assembly.

Turning now to the drawings wherein like reference characters refer to like and corresponding parts throughout the several views, the exhaust gas to the filtered flows from the internal combustion engine (not shown) through an exhaust pipe section 1 into a hollow inflow housing 2 coupled to the exhaust pipe, and from the housing the exhaust gas flows in the direciton of arrows 3, 4 and 5 into individual particulate filter traps 6, 7 and 8 and 6', 7' and 8' (FIG. 2). The traps are arranged side-by-side and parallel to the direction of exhaust gas flow therethrough. Each filter trap is preferably in the form of a ceramic honeycomb unit designed in such a manner that the exhaust gas be purified flows into depository channels A (FIG. 3) and reaches outlet channels B, while depositing the greatest amount of soot and other particulates on the ceramic walls of channels A, and is subsequently removed as purified gas through channels B flows in the direction of arrows 10, 11 and 12 and through an exhaust pipe section 13. The parallel flow channels of each particulate filter trap, shown in FIG. 3, are such that the inflow channels A are closed to the outflow side and the outflow channels B are closed to the inflow side, as shown in detail in commonly owned U.S. patent application Ser. No. 923,645, filed Oct. 27, 1986.

Figure 1:
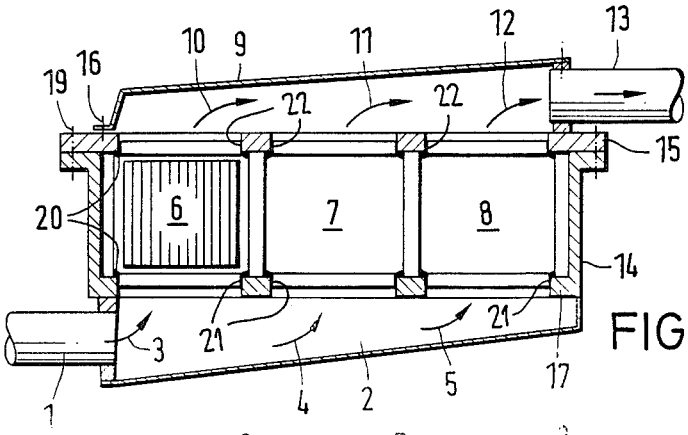
FIG. 1 is a schematic longitudinal sectional view taken through the assembly according to the invention.

The individual particulate filter traps are contained within a filter trap support in the form of a receptacle 14 and a cover 15 on the receptacle overlying the traps. Aligned openings 21 and 22 in the bottom wall of the receptacle and in the cover, respectively, are coaxial with the traps, as shown in FIG. 1. A hollow outflow housing 9 is coupled to exhaust pipe section 13, and housings 2, 9 are mounted on opposite sides of the trap support in open communication with the traps via the respective openings 21, 22. The outflow housing is mounted on cover 15 by means of threaded fasteners 16 or other quick-release fasteners, such that housing 9 can be quickly removed from the cover during a filter trap maintenance operation. After removing housing 9, filter trap damage among the various individual filter traps can be quickly and easily identified by the blackening which occurs as a result of the soot from the unfiltered exhaust gas passing therethrough.

Each of the ceramic filter traps 6, 7 and 8 and 6', 7' and 8' are housed within a sheet metal shell or sleeve 23 to thereby simplify replacement of the individual traps and to isolate the traps from each other within the assembly. This is in contrast to the prior art filter systems requiring a high cost and complex assembly expenditure in replacing the damaged filter traps and resealing the replaced traps within the assembly. The sheet metal shells surrounding the individual traps extend between cover 15 and bottom wall 17 of the receptacle, and the shells with the individual traps contained therein are immobilized in place within the assembly by mounting cover 15 to the receptacle by threaded fasteners 19 or the like which lie to the outside of the corrosive exhaust gas flow. The trap shells or the traps themselves are retained firmly and tightly between cover 15 and bottom wall 17 with the aid of seals 20 (FIG. 3).

The individual filter traps 6, 7 and 8 and 6', 7' and 8' are arranged at right angles to the inflow and outflow directions of the exhaust gas flowing through housings 2 and 9.

Removable housing 9 and removable cover 5 need be located on only one side of the filter traps, such as the exit side shown in FIG. 1, although housing 2 could alternatively be removably mounted on the entrance side of the traps together with the removable cover mounted on that side, without departing from the invention. Thus, by mounting the removable housing and cover on only one side at which an opening is to take place for monitoring and, if necessary, for replacement of the filters, such an assembly is of especially simple construction and gives rise to user-friendly monitoring and replacement of the filters.

As shown in FIG. 2, cover 15 may be divided along lines 24 and 25 into cover sections 15*a*, 15*b* and 15*c* with each cover section associated with two filter traps. Thus, only one such cover section need be removed for filter inspection and, when necessary, for filter replacement. Alternatively, the cover may be divided into fewer or more sections so that only one filter at a time or three filters are exposed upon cover removal. Thus, the time and effort involved in inspecting and replacing individual filter traps is considerably reduced.

As mentioned, the assembly may be arranged such that the filter traps can be inspected and removed from the inflow side, such that the exhaust gas flow direction in FIG. 1 would be reversed. Thus, pipe section 13 would lead from the engine, and the purified gas would exit through pipe section 1. The present arrangement can likewise be utilized in exhaust gas filtration using catalyzers in large engines when several catalyzers are necessary for the reduction of harmful pollutants. The catalyzers are likewise supported side-by-side within the assembly, such that replacement of damaged catalyzers can be carried out simply and rapidly.

What is claimed is:

1. An assembly for particulate filter traps in which engine exhaust gas particulates are deposited for the treatment of internal combustion engine emission, comprising a filter trap support including a receptacle containing a plurality of individual particulate filter traps arranged side-by-side and parallel to the direction of exhaust gas flow therethrough, a cover on said receptacle, aligned openings in said receptacle and cover coaxial with said traps, an inflow housing coupled to an exhaust pipe section leading from the engine, an outflow housing coupled to another exhaust pipe section through which treated exhaust gas flows, said housings being mounted on opposite sides of said trap support in open communication with said traps via said openings, one of said housings being removably mounted to said cover for inspection of said filter traps through said cover openings upon removal of said one housing, and said cover comprising a plurality of cover sections removably mounted on said receptacle, each of said sections being associated with at least one of said traps to facilitate trap replacement upon removal of at least one of said sections.

2. The assembly according to claim 1, wherein said traps bear against the bottom wall of said receptacle at one end, and said cover bears against said traps at the other end thereof for immobilizing said traps within said support.

3. The assembly according to claim 1, wherein metal shells surround each of said traps for isolating said traps from each other within said support.

* * * * *